US010689166B1

(12) United States Patent
Cheng

(10) Patent No.: US 10,689,166 B1
(45) Date of Patent: Jun. 23, 2020

(54) LID AND CONTAINER INCLUDING THE SAME

(71) Applicant: Zhejiang Haoda Science & Technology Co., Ltd, Jinhua (CN)

(72) Inventor: Haojun Cheng, Jinhua (CN)

(73) Assignee: Zhejiang Haoda Science & Technology Co., Ltd, Jinhua (CN)

( * ) Notice: Subject to any disclaimer, the term of this patent is extended or adjusted under 35 U.S.C. 154(b) by 11 days.

(21) Appl. No.: 16/268,466

(22) Filed: Feb. 5, 2019

(30) Foreign Application Priority Data

Dec. 21, 2018 (CN) ..... 2015 1 1570339
Dec. 21, 2018 (CN) ..... 2018 2 2163960 U

(51) Int. Cl.
*B65D 47/06* (2006.01)
*B65D 47/32* (2006.01)
*B65D 43/02* (2006.01)

(52) U.S. Cl.
CPC ..... *B65D 47/06* (2013.01); *B65D 43/0225* (2013.01); *B65D 47/32* (2013.01)

(58) Field of Classification Search
CPC ..... B65D 47/06; B65D 47/249; B65D 47/32; A47G 19/2272; Y10T 292/11
USPC ..... 220/714, 715, 230
See application file for complete search history.

(56) References Cited

U.S. PATENT DOCUMENTS 8,360,267 B1 * 1/2013 Chiou ..... A47G 19/2272 220/715
8,397,940 B2 * 3/2013 Steininger ..... A45F 3/18 220/254.1
8,464,895 B2 * 6/2013 Gilbert ..... A47G 19/2272 215/307
10,232,993 B2 * 3/2019 Seiders ..... A47G 19/2272
2012/0037651 A1 * 2/2012 Steuer ..... A47G 19/2272 220/714

* cited by examiner

*Primary Examiner* — Jeffrey R Allen

(57) ABSTRACT

The present disclosure discloses a lid, including a lid body having an outlet, a sealing member connected to the lid body and configured for sealing the outlet in a sealing state, the sealing member can include a first end, a middle part, and a second end; a first magnetic member disposed inside the middle part of the sealing member, a driving member mounted and movable inside the lid body and configured for pushing the sealing member to rotate and unseal the outlet; a second magnetic member disposed inside the driving member; and wherein the first magnetic member can attract the second magnetic member to maintain the sealing member at the sealing position and close the outlet.

14 Claims, 9 Drawing Sheets

LID AND CONTAINER INCLUDING THE SAME

CROSS-REFERENCE TO RELATED APPLICATIONS

This application claims all benefits accruing under 35 U.S.C. § 119 from China Patent Application Nos. 201811570339.X, filed on Dec. 21, 2018, and 201822163960.6, filed on Dec. 21, 2018, in the State Intellectual Property Office of China, the content of which is hereby incorporated by reference.

TECHNICAL FIELD

The present disclosure relates to a liquid container, in particular to a lid and a container including the same.

BACKGROUND

In the prior art, many lids are provided with a separate structure configured for opening and closing an outlet so that liquid in a container can flow out from the outlet of the lid. The lid and the cup thereof, which can be opened and closed by one hand, have also been developed. A metal elastic member such as torsion spring is usually used as a reset member of the lid to form a seal. However, the metal elastic member can lose its resilience over time, resulting in an inadequate reset function and seal.

SUMMARY

In order to provide a container with an outlet, which is easy to open and close, and convenient to use, an embodiment of the present disclosure includes a lid, including a lid body having an outlet, a sealing member connected to the lid body and configured for sealing the outlet in a sealing state, the sealing member can include a first end, a middle part, and a second end, and a first magnetic member is disposed inside the middle part of the sealing member, a driving member mounted and movable inside the lid body and configured for pushing the sealing member to rotate and unseal the outlet; a second magnetic member disposed inside the driving member; and the first magnetic member can attract the second magnetic member to maintain the sealing member at the sealing position.

Furthermore, a sliding slot can be defined inside the lid body, the sliding slot can have an opening disposed on a lid side surface of the lid body. An end of the sliding slot away from the opening can communicate with the outlet. The driving member can be located in the sliding slot and the sliding slot can be configured for guiding a movement of the driving member.

Furthermore, a stopping groove can be defined on a wall of the sliding slot and adjacent to the opening. A locking member is movable out of the driving member and slidable in the stopping groove, in order to limit the movement of the driving member in the sliding slot.

A button can be connected to an outer end of the driving member. A button slot is defined on the lid side surface of the lid body and connected to the opening of the sliding slot. The button slot can be configured for accommodating the button. And the button is configured for driving the driving member to move in the sliding slot.

The first end of the sealing member can include a rotating shaft, the sealing member is rotatably mounted to the lid body through the rotating shaft. A triggering protrusion facing and extending to the outlet can be disposed on the second end of the sealing member. When the button is pressed, the driving member can move toward the outlet, pushing the triggering protrusion and the sealing member to rotate away from the outlet to unseal the outlet. When the button is released after the button is pressed, the driving member can move away from the outlet by a magnetic attraction between the first magnetic member and the second magnetic member, which causes the sealing member to rotate back and seal the outlet.

The driving member can include a tilting surface contacting the triggering protrusion. The tilting surface can be configured for guiding the triggering protrusion to move away from the outlet when the button is pressed.

Furthermore, two opposite fixing brackets can be disposed on one side of the lid body, each of the fixing brackets defines a mounting hole, and two ends of the rotating shaft are respectively disposed in the mounting holes of the fixing brackets.

Each of the fixing brackets can further define a gap connected to the mounting hole. A width of the gap can be less than a diameter of the mounting hole. Each end of the rotating shaft includes a convex portion having a waisted shape. The convex portion can have a width less than the width of the gap and a length substantially equal to the diameter of the mounting hole. The convex portion can be disposed in the mounting hole. And when the convex portion in the mounting hole rotates to a released position, the rotating shaft can be detached from the fixing brackets through the gaps.

The sealing member is disposed opposite to the driving member, and the second magnetic member is opposite to the first magnetic member.

The lid side surface of the lid body can be provided with a vent hole. The button can be provided with a venting member corresponding to the vent hole. The vent hole can be connected to the button slot and pass through a wall of the button slot. A plurality of venting grooves can be located on a surface of the venting member. And the venting member can slide in the vent hole when the button is pressed.

The driving member can be provided with a sliding passage. The sliding passage can have a L-shape, one end of which extends out of the button and the other end of which extends to a wall of the driving member, and the sliding passage is configured for accommodating the locking member.

The locking member located in the sliding passage can be L-shaped, and one side of the locking member can be defined as a sliding portion, one end of the sliding portion adjacent to the button can be connected to a sliding piece, the sliding piece slides in a sliding groove defined on a wall of the sliding slot and adjacent to the opening. The other end of the sliding portion away from the button can be connected to a stopping portion sliding in the sliding passage and extending out of the driving member, in order to limit the movement of the driving member toward the outlet.

The triggering protrusion can be covered with a sealing pad sealing the outlet.

A container including the lid and a container body is provided.

The advantages of the lid and the container including the lid are as follows: the first magnetic member attracts the second magnetic member to maintain the sealing member at the sealing position, so that the outlet is closed. The driving member is able to move inside the lid body and can push the sealing member to rotate to an unsealing position and the outlet is open. If a pressure on the button is released, the driving member will return and the sealing member will rotate back under a magnetic force between the first magnetic member and the second magnetic member and the outlet is closed again. In this way, the outlet of the lid can be opened and closed conveniently, preventing the use of the metal elastic member in the art and ensuring stability of the lid. The sealing member and the driving member of the lid can be manually detached and cleaned conveniently.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Referring to FIGS. 1-3 and FIG. 9, an embodiment of the present disclosure includes a lid 100 including a lid body 10 with an outlet 11. The lid 100 can be coupled with a container body 200. The container body 200 may be sealed and connected with the lid 100 by ways of a threaded engagement, a clamping engagement, or the like.

Figure 1:
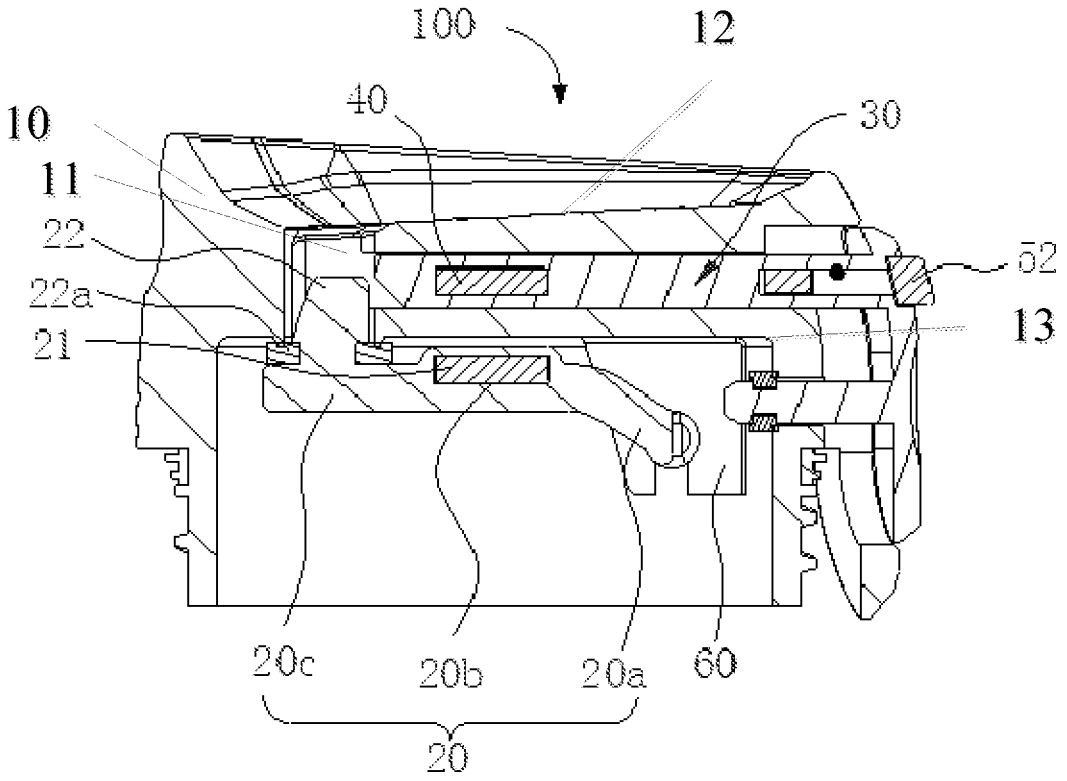
FIG. 1 is a cross-sectional view of a lid with the outlet in an open state according to an embodiment of the present disclosure.
Figure 4:
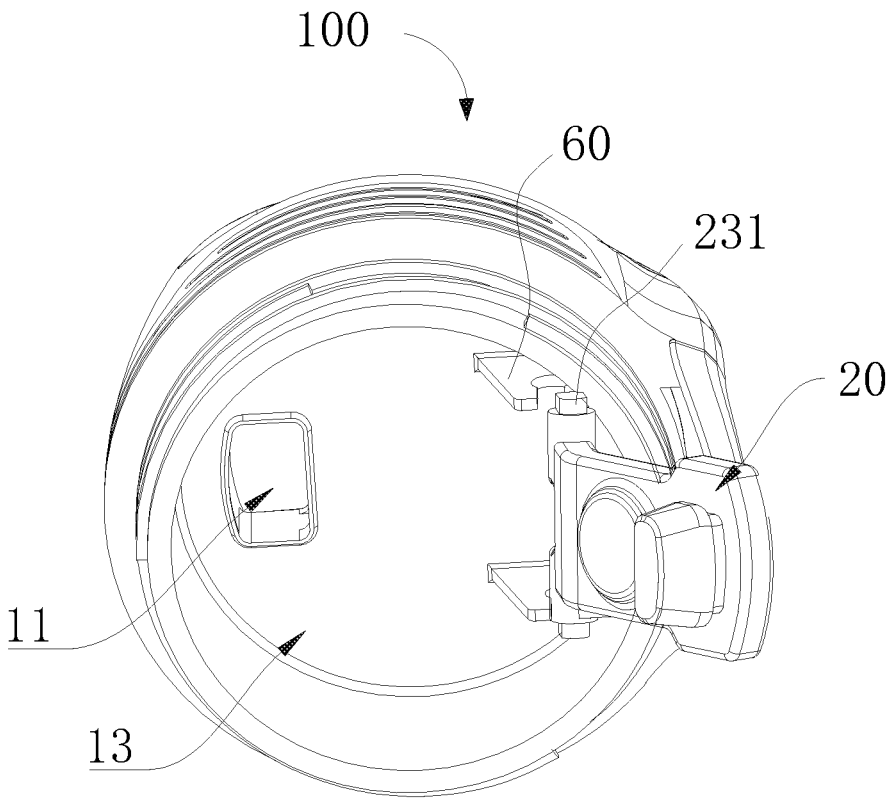
FIG. 4 is an exploded view of the lid of FIG. 3, viewed from another perspective, shown without the driving member, the sealing pad, and the sealing member.

Referring to FIG. 1 and FIG. 4, the lid 100 includes a lid top surface 12, a lid bottom surface 13, and a lid side surface 14. The lid top surface 12 is opposite to the lid bottom surface 13. The lid side surface 14 can be threaded.

The outlet 11 can extend through the lid body 10 from the lid bottom surface 13 to the lid top surface 12. Liquid such as water in the container body 200 can be flown out from the outlet 11.

As shown in FIG. 1, the lid 100 further includes a sealing member 20 and a driving member 30. The sealing member 20 is connected to the lid bottom surface 13 of the lid body 10. The sealing member 20 is configured for sealing the outlet 11. Said differently, the sealing member 20 forms a seal with the outlet 11. The sealing member 20 includes a first magnetic member 21. The driving member 30 is mounted inside the lid body 10. The driving member 30 is configured for pushing the sealing member 20 to rotate and open or unseal the outlet 11. A second magnetic member 40 is disposed inside the driving member 30. The second magnetic member 40 and the first magnetic member 21 can attract each other to maintain the sealing member 20 at a sealing state and seal the outlet 11.

Figure 3:
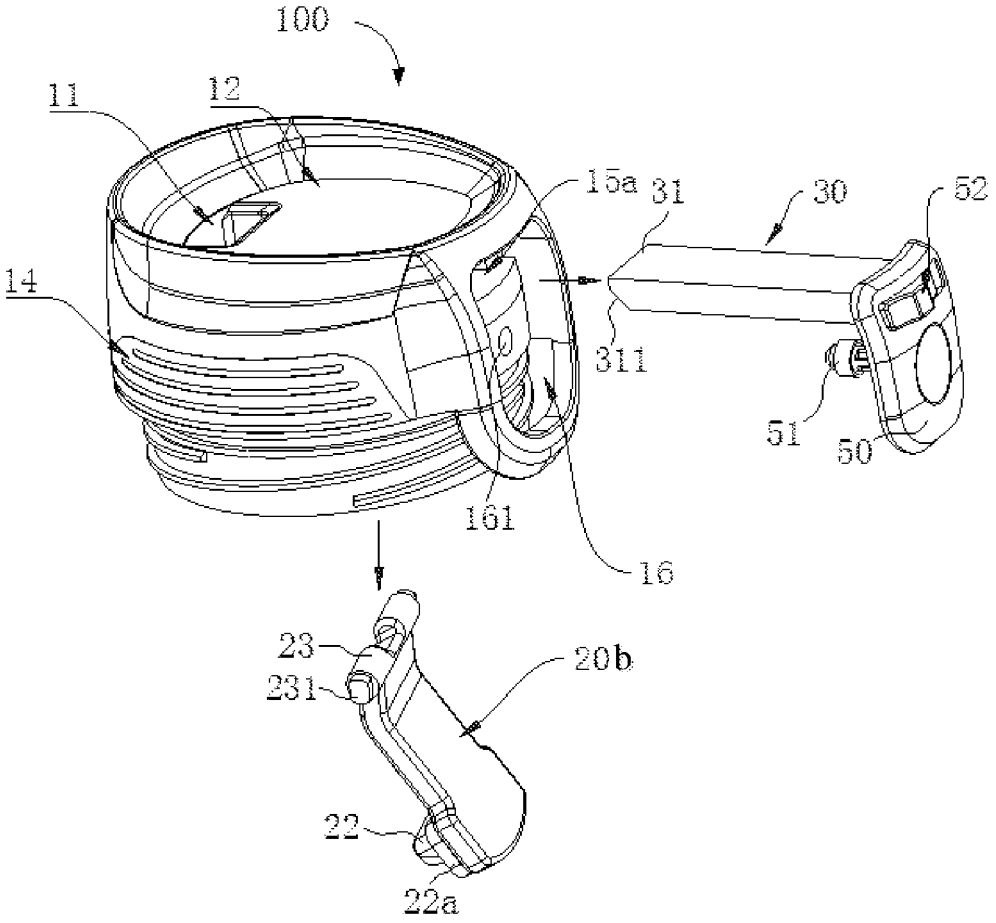
FIG. 3 is an exploded view of the lid shown in FIG. 1.

Referring to FIG. 3, the sealing member 20 can have a substantially rectangular and plate-like structure, which may be a flat plate structure or a curved panel structure having a certain bend angle. As shown in FIG. 1, the sealing member 20 can include a first end 20*a*, a middle part 20*b*, and a second end 20*c*. The first magnetic member 21 is disposed inside the middle part 20*b* of the sealing member 20. The first end 20*a* of the sealing member 20 can receive a rotating shaft 23 so that the sealing member 20 can be rotatably mounted to the lid body 10 via the rotating shaft 23. A triggering protrusion 22 extending into the outlet 11 in the sealing state is disposed on the second end 20*c* of the sealing member 20. The triggering protrusion 22 is configured to seal the outlet 11.

The sealing member 20 and the rotating shaft 23 may be integrally formed or may be separate structures. In one embodiment, the sealing member 20 and the rotating shaft 23 are integrally formed so that both the sealing member 20 and the rotating shaft 23 can be simultaneously rotated by the same angle.

Figure 5:
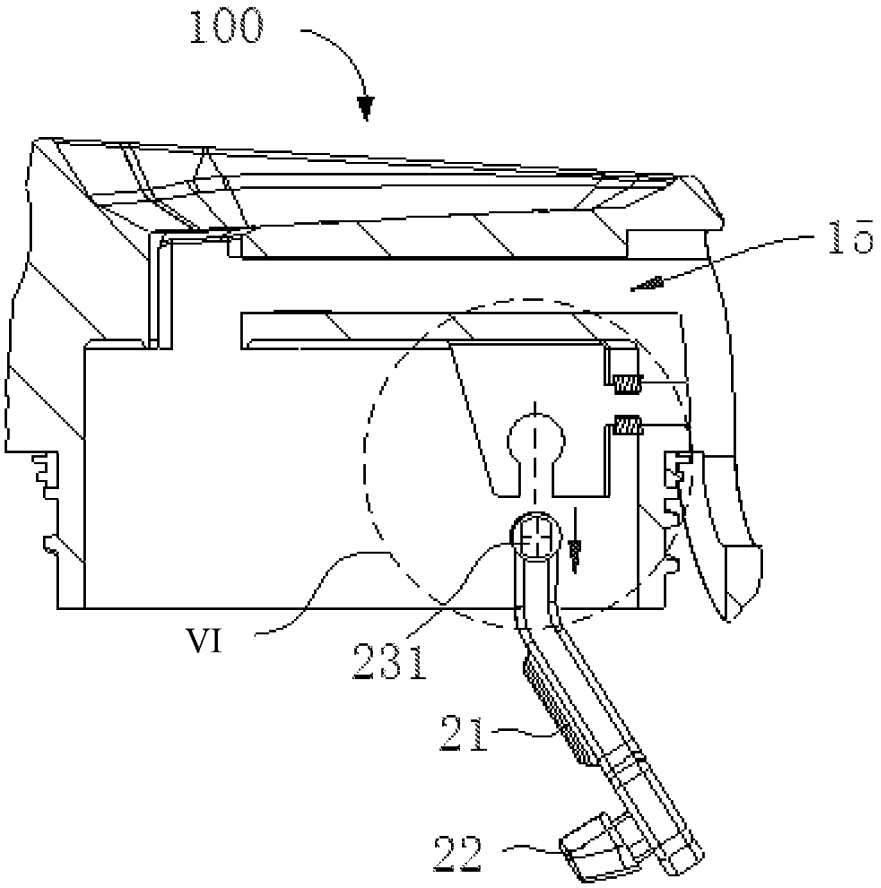
FIG. 5 is a cross-sectional view of the lid body and the driving member and a view of the sealing member.
Figure 6:
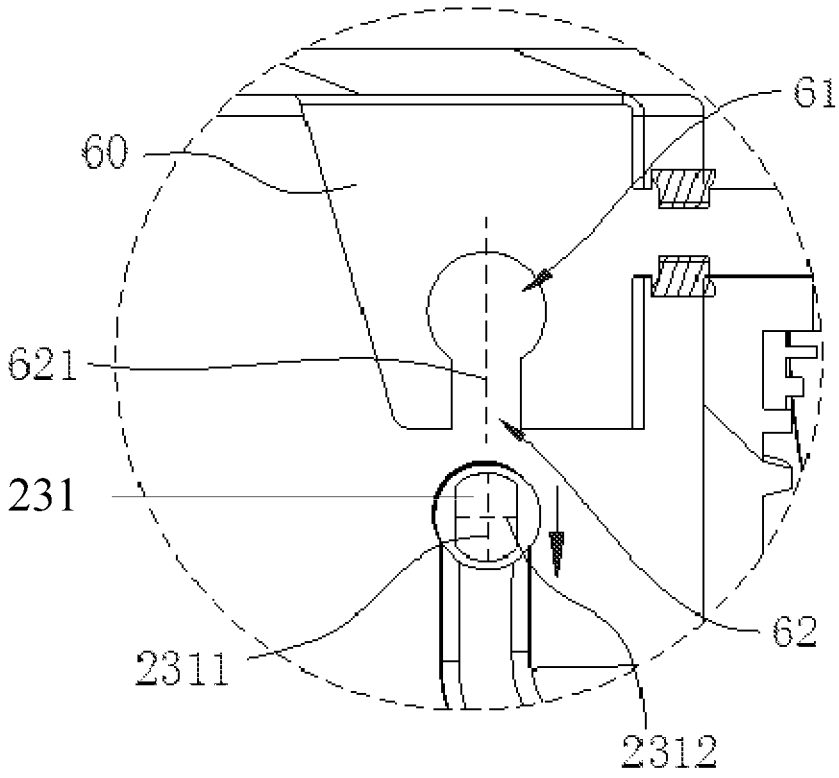
FIG. 6 is an enlarged view of circled portion VI of FIG. 5.

Referring to FIGS. 4-6, two opposite fixing brackets 60 can be disposed on the lid bottom surface 13 of the lid body 10. Each of the fixing brackets 60 is provided with a mounting hole 61. The mounting holes 61 are opposed to each other so that the rotating shaft 23 at both ends of the rotating shaft 23 can be inserted and received in the mounting holes 61 and the rotating shaft 23 can be rotatable in the mounting holes 61.

Furthermore, each of the fixing brackets 60 can be further provided with a gap 62 communicating with the respective mounting hole 61. The gap 62 is configured for guiding the rotating shaft 23 into and out of the mounting holes 61. Each end of the rotating shaft 23 can be provided with a convex portion 231 mounted in the mounting holes.

Referring to FIG. 5 and FIG. 6, a cross section of the convex portion 231 can have a substantially waisted shape with a length along a first axis 2311 which is greater than a width along a second axis 2312. The length of the convex portion 231 is greater than a width of the gap 62. The width of the convex portion 231 is slightly less than the width of the gap 62. The width of the gap 62 is less than a diameter of the mounting hole 61.

To insert the sealing member 20 into the mounting hole 61 or removing the sealing member 20 out from the mounting hole 61, the sealing member 20 is rotated and translated until the first axis 2311 of the convex portion 231 coincides with an axis 621 of the gap 62 with the shorter side of the convex portion 231 facing walls of the gap 62. At this position, the sealing member 20, or more specifically, the convex portion 231 or the sealing member 20 is in a released position. Because the width of the convex portion 231 is slightly less than the width of the gap 62, the convex portion 231 can be smoothly inserted and removed from the mounting hole 61 through the gap 62. For example, when the convex portion 231 in the mounting hole 61 rotates to the release position, the rotating shaft 23 can be removed from the fixing brackets through the gaps 62, so that the sealing member 20 can be removed from the lid body 10. When assembling the sealing member 20 back to the lid body 10, the sealing member 20 is rotated and translated until the first axis 2311 of the convex portion 231 coincides with the axis 621 of the gap 62 (i.e., the released position), and the convex portion 231 is slid through the gap 62 into the mounting holes 61, at which time, the sealing member 20 is rotated until the first axis 2311 of the convex portion 231 no longer coincides with the axis 621 of the gap 62, so that the convex portion 231 is confined within the mounting hole 61 because the length of the convex portion 231 is greater than a width of the gap 62. At this position, the sealing member 20, or more specifically, the convex portion 231 is in an unreleased position, Furthermore, a center of gravity of the sealing member 20 can be offset from the first axis 2311 of the convex portion 231, so that when the lid 100 is vertically placed, the center of gravity of the sealing member 20 is not aligned with an axis of the gap 62. When the convex portions 231 of the sealing member 20 are inserted into the mounting holes 61 through the gaps 62, the sealing member 20 is automatically rotated under its own weight from the released position to the unreleased position, thereby preventing the sealing member 20 from accidentally falling off from the lid body 10 during installation. Thus, the sealing member 20 can be easily removed and installed on the lid body 10, so that the lid body 10 can be cleaned after the sealing member 20 is detached from the lid body 10.

Figure 2:
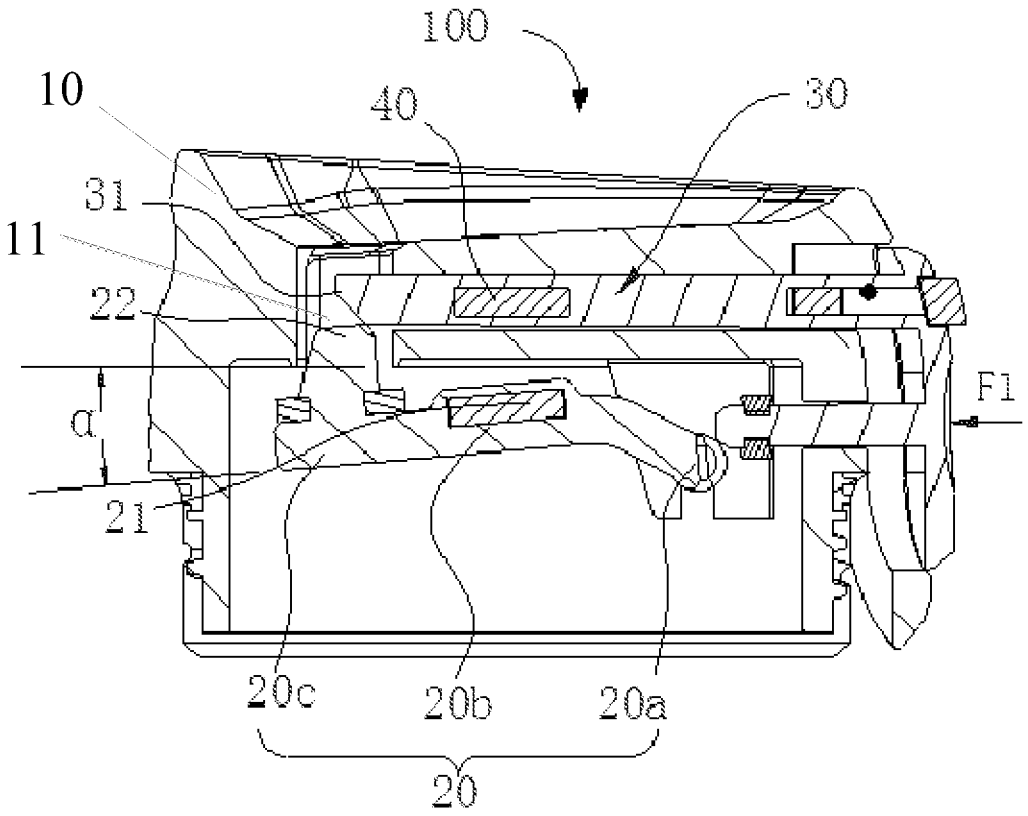
FIG. 2 is a cross-sectional view of a lid of FIG. 1, with the outlet in a closed state.

Referring to FIG. 2, the triggering protrusion 22 of the sealing member 20 can be moved away from the outlet 11 thereby breaking the seal by application of a force F1 to the driving member 30, thereby driving the sealing member 20 to rotate an angle $\alpha$. The angle $\alpha$ may be less than 20 degrees.

When the sealing member 20 is in a sealing state, the triggering protrusion 22 is engaged in the outlet 11 and abuts against an inner wall of the outlet 11, thereby closing and sealing the outlet 11.

In another embodiment, referring to FIG. 1 and FIG. 2, an outer circumference of the triggering protrusion 22 or the inner wall of the outlet 11 may be covered with a sealing pad 22*a* in order to achieve a better sealing effect. The sealing pad 22*a* can be made by a silica gel material. The silica gel material has a certain elasticity and is safe, hygienic and non-toxic. It can be understood that the triggering protrusion 22 can also be coated with other elastic materials such as rubber.

A first magnetic member 21 can be disposed in the sealing member 20. Preferably, the first magnetic member 21 can be disposed inside the middle part 20*b* of the sealing member 20. The first magnetic member 21 and the second magnetic member 40 disposed inside the driving member 30 can attract each other and form a magnetic buckle structure.

It can be understood that the first magnetic portion 21 may be disposed at a position of the sealing member 20 that is relatively close to the outlet 11, or may be disposed at a position of the sealing member 20 relatively far from the outlet 11, as long as the first magnetic member 20 can attract the second magnetic member 40 to maintain the sealing member 20 at the sealing state.

Referring to FIG. 3 and FIG. 5, a sliding slot 15 can be defined inside the lid body 10. The sliding slot 15 can be configured to accommodate the driving member 30. That is, the driving member 30 can be located and slide within the sliding slot 15. The sliding slot 15 can have an opening 15*a* at the lid side surface 14. The sliding slot 15 can be substantially parallel to the lid top surface 12 of the lid body 10. The sliding slot 15 can be disposed adjacent to the sealing member 20 to ensure the magnetic attraction between the first magnetic member 21 and the second magnetic member 40. An end of the sliding slot 15 away from the opening 15*a* can communicate with the outlet 11.

In one embodiment, the driving member 30 has a substantially rectangular strip-like structure. The driving member 30 is configured to push the sealing member 20 to rotate, in order to open the outlet 11.

Referring to FIG. 3, the driving member 30 can include a driving end 31 adjacent to the outlet 11. Referring to FIG. 2, under an external force F1, the driving member 30 can slide toward the outlet 11 and press the triggering protrusion 22, resulting in rotation of both the triggering protrusion 22 and the sealing member 20 to unseal and open the outlet 11. The external force F1 should also be large enough to overcome the magnetic force between the first magnetic member 21 and the second magnetic member 40. Referring to FIG. 1, after the external force F1 is released, the first magnetic member 21 will be attracted by the second magnetic member 40, thereby causing the triggering protrusion 22 and the sealing member 20 to rotate back to close the outlet 11, and drive the driving member 30 away from the outlet 11.

Referring to FIG. 3, the driving end 31 of the driving member 30, which contacts the triggering protrusion 22, can include a tilting surface 311. The tilting surface 311 can be disposed obliquely to guide the triggering protrusion 22 to move away from the outlet 11. A certain acute angle is formed between the tilting surface 311 and sliding direction of the driving member 30. A highest part of the tilting surface 311 can be higher than a highest part of the trigger protrusion 22, so that the driving member 30 can smoothly push the triggering protrusion 22 to open the outlet 11. It can be understood that the tilting surface 311 or driving end 31 can have a curved structure.

It can be understood that the driving member 30 can have other shapes, such as a block shape, a column shape, or the like, as long as the driving member 30 can drive the sealing member 20 to move and release the closed or sealing state of the outlet 11. The driving member 30 may also be disposed at other positions of the lid body 10 as long as the driving member 30 can push the triggering protrusion 22 to move away from the outlet 11.

For example, the driving member 30 can be rotatably mounted on the lid top surface 12 of the lid body 10. An interlocking eccentric lug (not shown) can be disposed between the driving member 30 and the sealing member 20. When the driving member 30 is turned, the eccentric lug will rotate, and a correspondingly protrusion (not shown) on the sealing member 20 will be pushed and the sealing member 20 will rotate away from the outlet 11, thereby opening the outlet 11. At this time, the sealing member 20 and the driving member 30 can return by magnetic attraction between the first magnetic portion 21 and the second magnetic member 40.

The second magnetic member 40 can be disposed inside the driving member 30. The driving member 30 can be disposed opposite to the sealing member 20. The second magnetic member 40 can be disposed opposite to the first magnetic member 21 of the sealing member 20 and attracted to each other, thereby maintaining the sealing member 20 at the sealing state and closing the outlet 11.

The first magnetic member 21 can be disposed inside the sealing member 20. The second magnetic member 40 can be disposed inside the driving member 30. Therefore, the first magnetic member 21 and the second magnetic member 40 will not directly contact the liquid in the container body 200, and the first magnetic member 21 and the second magnetic member 40 can be covered by rubber or silica gel to ensure safety of the liquid.

The principle of opening and closing the outlet 11 will be explained as follows:

As shown in FIG. 1, when the sealing member 20 is at the sealing state, the second magnetic member 40 can magnetically attract the first magnetic member 21, and the triggering protrusion 22 covers and extends in the outlet 11, resulting in a closing of the outlet 11.

As shown in FIG. 2, when the external force F1 acts on the driving member 30, the driving member 30 can slide towards the outlet 11 and the tilting surface 311 of the driving end 31 will abut against the trigger protrusion 22. By further pushing the driving member 30, the driving end 31 drives the triggering protrusion 22 to move away from the outlet 11 and drives the sealing member 20 to rotate at the same time. When the driving member 30 moves to an extreme position, the triggering protrusion 22 stops moving, and thus the sealing member 20 deflects by an angle α. That is, a gap is formed between an inner wall of the outlet 11 and the triggering protrusion 22, so that the liquid can flow out from the gap, thereby releasing the sealing state of the sealing member 20 and opening the outlet 11.

It should be noted that, when the outlet 11 is open, the second magnetic member 40 and the first magnetic member 21 is at a certain distance, but the second magnetic member 40 can still provide a magnetic attraction force for returning the sealing member 20. After removing the external force, the driving member 30 and the sealing member 20 can return by the magnetic attraction force between the second magnetic member 40 and the first magnetic member 21, and the sealing member 20 can return to the sealing state, and at the same time, the driving member 30 can move back.

Figure 8:
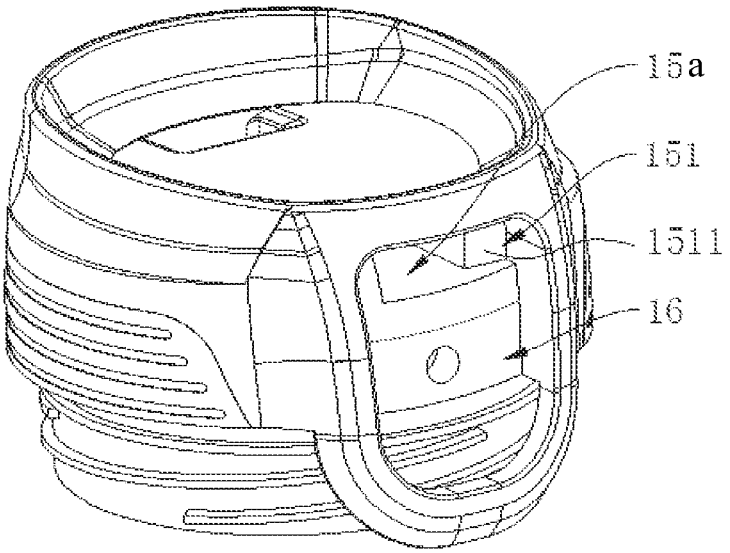
FIG. 8 is a perspective view of the lid body of the lid shown in FIG. 1.
Figure 9:
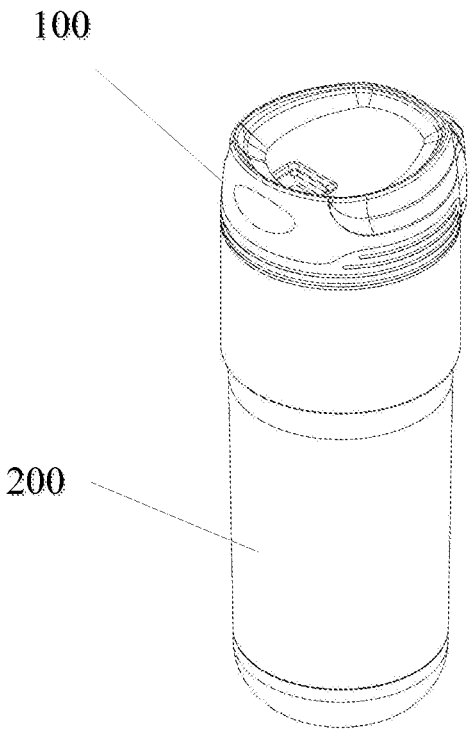
FIG. 9 is a perspective view of a container with the lid of FIG. 1.

Referring to FIG. 5 and FIG. 8, a button slot 16 can be defined on the lid side surface 14 of the lid body 10. The button slot 16 communicates with the opening 15*a* of the sliding slot 15. A button 50 can be connected to an outer end of the driving member 30 and located in the button slot 16. The button 50 can be configured to drive the driving member 30 to slide toward the outlet 11. The button 50 can extend into the button slot 16 by the external force and drive the driving member 30 to slide toward the outlet 11. When the button 50 abuts against a side wall of the button slot 16, the driving end 31 of the driving member 30 pushes the triggering protrusion 22 to rotate.

Figure 7:
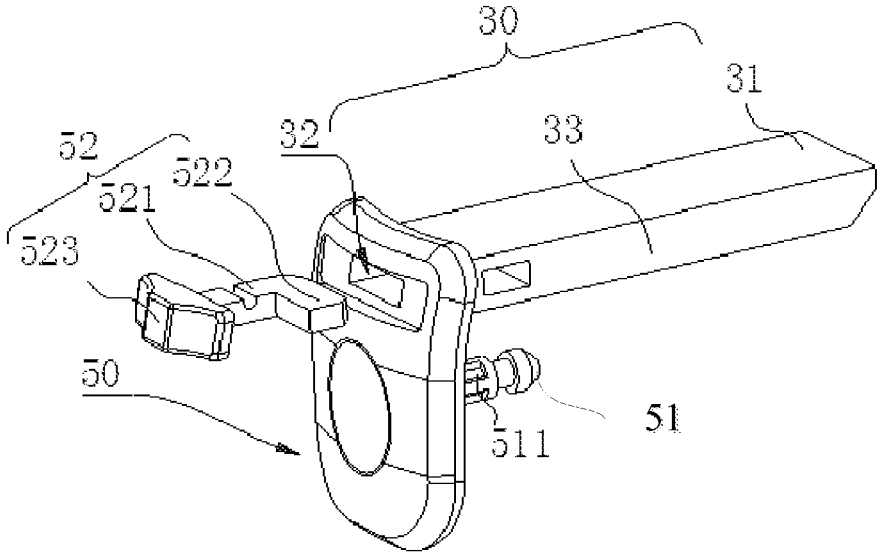
FIG. 7 is an exploded view of the driving member of the lid shown in FIG. 1.

Referring to FIG. 3, FIG. 7 and FIG. 8, the lid side surface 14 of the lid body 10 is provided with a vent hole 161. The button 50 is provided with a venting member 51 corresponding to the vent hole 161. The vent hole 161 is connected to the button slot 16 and passes through the side wall of the button slot 16. The venting member 51 can slide in the vent hole 161 when the button 50 is pressed.

The venting member 51 can have a substantially rod-like shape, and a plurality of venting grooves 511 are located on surface of the venting member 51. When the button 50 is pressed, the venting member 51 can move toward the outlet 11 and the gas can flow through the plurality of venting grooves 511 and the external air pressure is substantially equal to inside air pressure of the container body 200, thereby making it is easy to press the button 50 and smoothly open the outlet 11.

Referring to FIG. 7, the driving member 30 can be provided with a locking member 52. When the lid 100 is in a closed state, the locking member 52 will hinder the movement of the driving member 30, so that the button 50 cannot be pressed down and the driving member 30 cannot slide toward the outlet 11. That is, the locking member 52 can place the button 50 and the driving member 30 in a locked state to prevent accidental pressing of the button 50. When the locked station of the button 50 and the driving member 30 is released, the button 50 can be pressed down and the driving member 30 can slide in the sliding slot 15. Since the second magnetic member 40 and the first magnetic member 21 will be attracted to each other, the driving member 30 can be located in the sliding slot 15, and prevented from slipping out of the sliding slot 15 accidentally.

A sliding direction of the driving member 30 in the sliding slot 15 is defined as a first direction, and a direction perpendicular to the first direction and parallel to a surface of the driving member 30 is defined as a second direction. Referring to FIG. 7 and FIG. 8, the driving member 30 is provided with a sliding passage 32. The sliding passage 32 has a substantially "L" shape, one end of which extends out of the button 50 and the other end of which extends to a side wall 33 of the driving member 30. The sliding passage 32 is configured to accommodate the locking member 52.

The locking member 52 can be substantially "L"-shaped, and one side of the "L" shaped locking member 52 is defined as a sliding portion 521. The sliding portion 521 can be mounted in the sliding passage 32. One end of the sliding portion 521 adjacent to the button 50 can be connected with a sliding piece 523. The sliding piece 523 can slide along the second direction in a stopping groove 151 defined on a side wall of the sliding slot 15 and adjacent to the opening 15*a*. The other end of the sliding portion 521 away from the button 50 can be connected with a stopping portion 522. The stopping portion 522 can slide in the sliding passage 32 and extend out of the driving member 30. When the sliding piece 523 moves along the second direction by a force, the sliding portion 521 and the stopping portion 522 can move in the sliding passage 32 along the second direction and the stopping portion 522 can slide out of the side wall of the driving member 33 and the sliding portion 521 enters the stopping groove 151, in order to limit the movement of the driving member 30 toward the outlet 11.

Referring to FIG. 8, a stepped surface 1511 is formed between the stopping groove 151 and the button slot 16. When the sliding piece 523 moves into the stopping groove 151, the stopping portion 522 will abut against the stepped surface 1511, and the driving member 30 cannot slide toward the outlet 11 even though the button 50 is pressed. When the sliding piece 523 returns and the stopping portion 522 is completely inside the driving member 30, the driving member 30 can slide along the first direction in the sliding groove 15 when the button 50 is pressed.

Referring to FIG. 3, when the sealing member 20 is rotated by a certain angle, the sealing member 20 is detached from the lid body 10, and the magnetic attraction force between the first magnetic member 21 and the second magnetic member 40 will disappear. When tilting the lid body 10, the driving member 30 can be laterally slid out of the lid body 10. In this way, the lid body 10, the sealing member 20, and the driving member 30 can be removed for cleaning.

The first magnetic member 21, the second magnetic member 40 and the driving member 30 on the cup cover 100, allows the sealing member 20 to continuously maintained and held by mutual attraction between the first magnetic member 21 and the second magnetic member 40. In the closed position, the driving member 30 can release the sealing of the outlet 11 by the sealing member 20. In the case of the removal of the external force, the driving member 30 and the sealing member 20 can attract each other by the magnetic force between the magnetic portion 21 and the magnetic restoring member 40. The design allows the lid 100 to be open and closed at any time, avoiding the defects caused by the use of the metal device as a reset member in the conventional design (the problem of easy deformation, loss of elasticity, easy to lose, etc.), and the reliability of the lid 100 can be ensured. Additionally, the main components on the lid 100 can be manually removed at any time, which facilitates the maintenance and cleaning of the lid 100 and the entire cup.

The present disclosure also provides a container comprising a container body 200 and the lid 100 of the above embodiment, and a sealing ring added to the lid 100 and the container body 200 to increase the overall sealing performance of the container. The container body 200 can have a double-layer structure, or a single-layer structure. The container can be opened and closed with one hand by providing the lid 100.

The advantages of the lid 100 and the container including the lid 100 are as follows: the first magnetic member 21 attracts the second magnetic member 40 to maintain the sealing member 20 at the sealing position, so that the outlet 11 is closed. The driving member is able to move inside the lid body 10 and can push the sealing member 20 to rotate to an unsealing position to open the outlet 11. If a pressure on the button 50 is released, the driving member 30 will return and the sealing member 20 will rotate back under a magnetic force between the first magnetic member 21 and the second magnetic member 40 and the outlet 11 is closed. In this way, the outlet 11 of the lid 100 can be opened and closed conveniently. The sealing member 20 and the driving member 30 of the lid 100 can be manually detached and cleaned conveniently.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A lid, comprising:

a lid body having an outlet;

a sealing member connected to the lid body and configured for sealing the outlet in a sealing state, the sealing member comprising a first end, a middle part, and a second end;

a first magnetic member disposed inside the middle part of the sealing member;

a driving member mounted and movable inside the lid body and configured for pushing the sealing member to rotate and unseal the outlet;

a second magnetic member disposed inside the driving member; and wherein the first magnetic member attracts the second magnetic member to maintain the sealing member at the sealing state.

2. The lid of claim 1, wherein a sliding slot is defined inside the lid body, the sliding slot has an opening disposed on a lid side surface of the lid body, an end of the sliding slot away from the opening communicates with the outlet, the driving member is located in the sliding slot and the sliding slot is configured for guiding a movement of the driving member.

3. The lid of claim 2, wherein a stopping groove is defined on a wall of the sliding slot and adjacent to the opening, a locking member is movable out of the driving member and slidable in the stopping groove, in order to limit the movement of the driving member in the sliding slot.

4. The lid of claim 2, wherein a button is connected to an outer end of the driving member, a button slot is defined on the lid side surface of the lid body and connected to the opening of the sliding slot, the button slot is configured for accommodating the button, and the button is configured for driving the driving member to move in the sliding slot.

5. The lid of claim 4, wherein the first end of the sealing member comprises a rotating shaft, the sealing member is rotatably mounted to the lid body through the rotating shaft, and a triggering protrusion facing and extending to the outlet is disposed on the second end of the sealing member;

when the button is pressed, the driving member moves toward the outlet, pushes the triggering protrusion and the sealing member to rotate away from the outlet to unseal the outlet; and when the button is released after the button is pressed, the driving member moves away from the outlet by a magnetic attraction between the first magnetic member and the second magnetic member, which causes the sealing member to rotate back and seal the outlet.

6. The lid of claim 5, wherein the driving member comprises a tilting surface contacting the triggering protrusion, and the tilting surface is configured for guiding the triggering protrusion to move away from the outlet when the button is pressed.

7. The lid of claim 5, wherein two opposite fixing brackets are disposed on one side of the lid body, each of the fixing brackets defines a mounting hole, and two ends of the rotating shaft are respectively disposed in the mounting holes of the fixing brackets.

8. The lid of claim 7, wherein each of the fixing brackets further defines a gap connected with the mounting hole, a width of the gap is less than a diameter of the mounting hole, each end of the rotating shaft comprises a convex portion having a waisted shape, the convex portion has a width less than the width of the gap and a length substantially equal to the diameter of the mounting hole, the convex portion is disposed in the mounting hole, and when the convex portion in the mounting hole rotates to a released position, the rotating shaft is detached from the fixing brackets through the gaps.

9. The lid of claim 8, wherein the sealing member is disposed opposite to the driving member, and the second magnetic member is opposite to the first magnetic member.

10. The lid of claim 4, wherein the lid side surface of the lid body is provided with a vent hole, the button is provided with a venting member corresponding to the vent hole, the vent hole is connected to the button slot and passes through a wall of the button slot, a plurality of venting grooves are located on a surface of the venting member, and the venting member can slide in the vent hole when the button is pressed.

11. The lid of claim 4, wherein the driving member is provided with a sliding passage, the sliding passage having an L-shape, one end of which extends out of the button and the other end of which extends to a wall of the driving member, and the sliding passage is configured for accommodating the locking member.

12. The lid of claim 11, wherein the locking member located in the sliding passage is L-shaped, and one side of the locking member is defined as a sliding portion, one end of the sliding portion adjacent to the button is connected with a sliding piece, the sliding piece slides in a sliding groove defined on a wall of the sliding slot and adjacent to the opening, the other end of the sliding portion away from the button is connected with a stopping portion sliding in the sliding passage and extending out of the driving member, in order to limit the movement of the driving member toward the outlet.

13. The lid of claim 1, wherein the triggering protrusion is covered with a sealing pad sealing the outlet.

14. A container comprising the lid of claim 1 and a container body.

* * * * *